United States Patent [19]

Beigh

[11] 4,242,773

[45] Jan. 6, 1981

[54] CABINET HINGE

[76] Inventor: Lauris L. Beigh, 9801 - 47th Ave. SW., Seattle, Wash. 98136

[21] Appl. No.: 934,429

[22] Filed: Aug. 17, 1978

[51] Int. Cl.[2] ..... E05D 3/06

[52] U.S. Cl. ..... 16/164

[58] Field of Search ..... 16/162, 163, 173, 183, 16/164

[56] References Cited

U.S. PATENT DOCUMENTS

| | | | |
|---|---|---|---|
| 619,689 | 2/1899 | Moore | 16/183 |
| 1,418,076 | 5/1922 | Hedstrom | 16/163 |
| 2,433,305 | 12/1947 | Talcott, Jr. | 16/163 |
| 2,707,798 | 5/1955 | Comey et al. | 16/163 |
| 2,883,699 | 4/1959 | Gross | 16/163 |
| 3,832,756 | 9/1974 | Lew | 16/163 |
| 4,100,647 | 7/1978 | Guiraud | 16/163 X |

FOREIGN PATENT DOCUMENTS

| | | | |
|---|---|---|---|
| 366470 | 2/1963 | Switzerland | 16/183 |
| 491872 | 9/1938 | United Kingdom | 16/163 |
| 635083 | 4/1950 | United Kingdom | 16/163 |

*Primary Examiner*—Wm. Carter Reynolds
*Attorney, Agent, or Firm*—Francis Swanson

[57] ABSTRACT

A hinge for kitchen cabinets and the like is disclosed. The hinge includes means for sequentially pivoting the door about two pivot axes. The hinge includes a sequencing link which locks certain hinge members for pivotal movement about a first pivot axis, then unlocks those members while locking others so that pivoting takes place about another pivot axis. An optional automatic door closing mechanism is also shown.

2 Claims, 10 Drawing Figures

CABINET HINGE

BACKGROUND OF THE INVENTION

1. Field of the Invention

The invention pertains to hinges in general and more particularly to those having multiple pivotal axes and a sequencing link.

2. Description of the Prior Art

Numerous hinges are known in the prior art. Multiple pivot axis hinges are also known. Some examples are U.S. Pat. No. 406,247 to Webb; U.S. Pat. No. 2,901,766 to Marquis; and U.S. Pat. No. 3,619,853 to Merrill.

Others teach the recessing of the mechanism into the door and cabinet to conceal the hinge.

Most prior art devices do not address themselves to the problem of providing both a compact hinge and one that can be completely hidden. The present invention achieves both these goals.

3. Objects and Advantages

A principal object of the invention is to provide a hinge that can be completely hidden.

A further object is to provide a hinge with dual pivot axes linked so as to provide sequential pivoting.

A further object is to provide a hinge which includes a floating sequencing link to induce and control sequential pivoting.

Other objects and advantages will be apparent to those skilled in the art.

DETAILED DESCRIPTION

Figure 1:
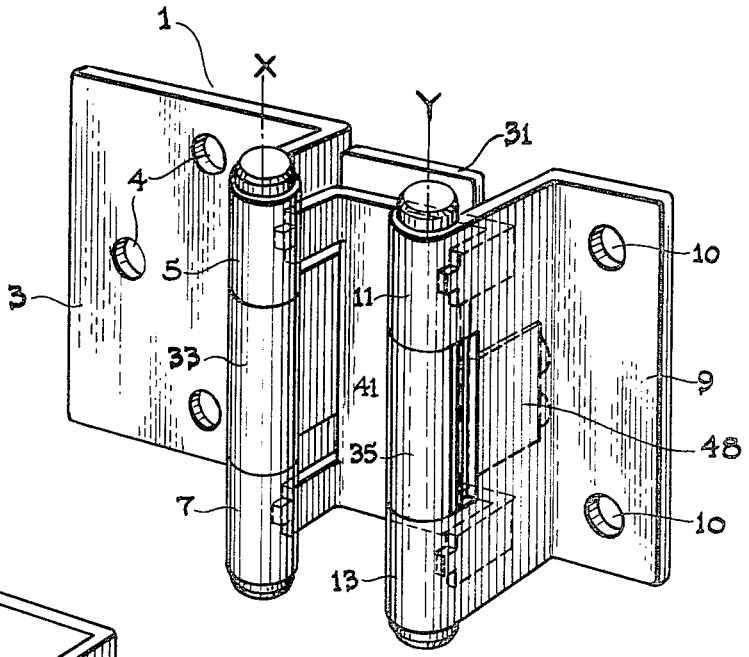
FIG. 1 is a perspective view of the invention.
Figure 2:
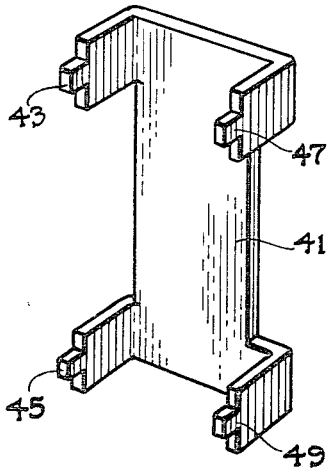
FIG. 2 is a perspective view of the sequencing link.
Figure 3:
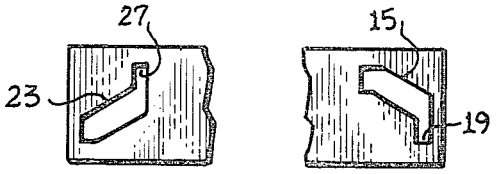
FIG. 3 is a schematic presentation of the cam slots.

Referring now to the drawings, FIG. 1 shows the hinge, indicated generally by the numeral 1. Hinge 1 includes a door plate 3 which defines a plurality of mounting holes 4. Plate 3 is of generally L-shaped cross-section, and further defines two separated rounded pin-engaging journals 5 and 7. Hinge 1 also includes a jamb plate 9 which defines plural mounting holes 10. Plate 9 is of generally L-shaped cross-section, and further defines two separated rounded pin-engaging journals 11 and 13. Journals 5 and 7 define curved cam slots 15 and 17 which terminate at their lower ends in locking notches 19 and 21. Journals 11 and 13 also define curved cam slots 23 and 25 which terminate at their upper ends in locking notches 27 and 29. The cam slots in all the journals act in part as guide means for a sequencing link to be described below. Slots 15 and 23 and notches 19 and 27 are shown schematically in FIG. 3.

A hinge plate 31, of generally U-shaped configuration and defining rounded pin-engaging journals 33 and 35 at its ends, mates with plates 3 and 9. When hinge 1 is assembled journals 5, 7 and 33 are held in place by, and pivot upon, pin 37 which defines a first pivot axis X. Likewise, journals 11, 13 and 35 are held in place by and pivot upon pin 39, which defines a second pivot axis Y.

A floating sequencing link 41 having four protruding ears 43, 45, 47 and 49 mate with the slots and notches in the hinge journals. Ears 43 and 45 engage slots 15 and 17 while ears 47 and 49 engage slots 23 and 25. Sequencing link 41 is retained in position by hinge plate 31. Link 41 is free to float up or down in the slots 15, 17, 23 and 25 but cannot fall out because it is substantially surrounded by and nested within plate 31. An optional self-closing mechanism, shown here as a spring 48 may be included so as to engage jamb plate 9 and hinge plate 31 to provide for automatic closing of the doors.

Figure 4:
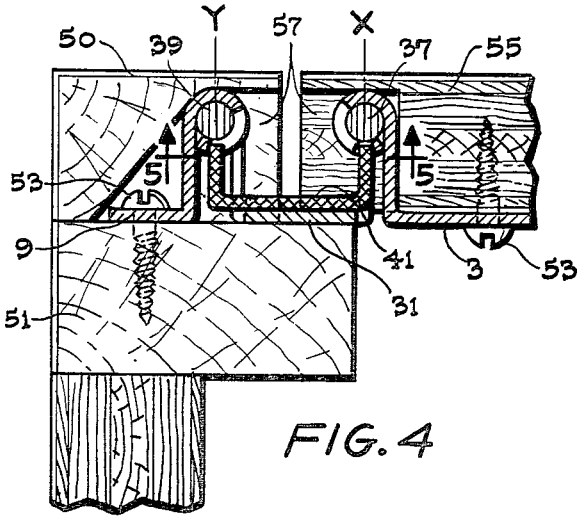
FIG. 4 is a plan view of the hinge on a cabinet and door.
Figure 5:
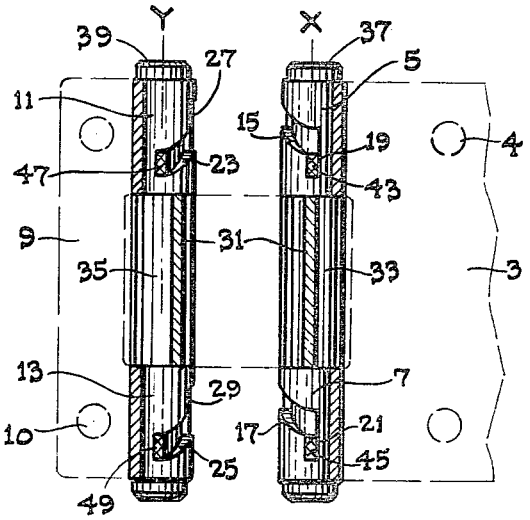
FIG. 5 is an elevation taken along line 5—5 of FIG. 4 showing schematically the sequencing link ears and cam slots. Hinge elements are shown in phantcm.

Referring now to FIG. 4, hinge 1 is shown mounted by attachment of jamb plate 9 to cabinet 51 by attachment securely thereon with conventional wood screws 53 through mounting holes 10. Door plate 3 is attached to cabinet door 55 with screws 53 through mounting holes 4. Mortices 57 are cut into the cover stile 50 and door 55. Hinge 1 fits into mortices 57. In this manner the hinge is not seen by one viewing the cabinet and door when the door is closed. It will be apparent to those skilled in the art that a variety of morticing and stile arrangements could be used in mounting the hinge. In some instances it might be advantageous not to use stiles at all and mount the hinge directly on the cabinet and door.

FIG. 1 shows the optional automatic door closing mechanism 48. These devices are well known in the art and will be readily understood by those skilled therein.

OPERATION

FIG. 4 shows the hinge 1 mounted on cabinet 51 with door 55 closed. In this position sequencing link 41 is positioned so that ears 43 and 45 are in the bottom of curved slots 15 and 17 in journals 5 and 7 in engagement with locking notches 19 and 21. Ears 47 and 49 are likewise at the bottom of slots 23 and 25 of journals 11 and 13 but are out of engagement with locking notches 27 and 29 which are at the top of slots 23 and 25.

Figure 6:
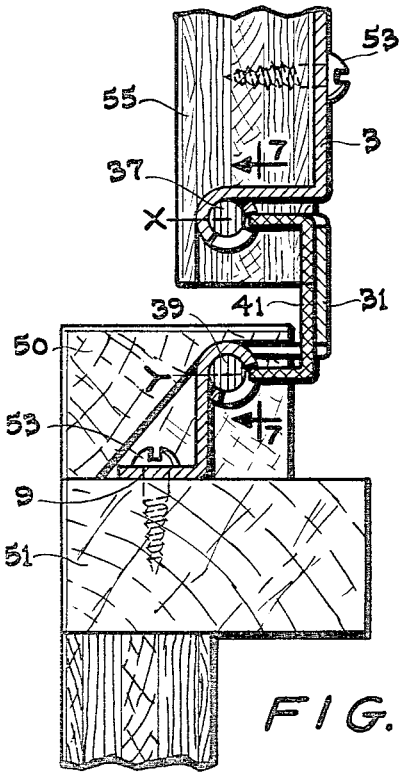
FIG. 6 is the plan view of FIG. 5 with the door pivoted open 90°.
Figure 7:
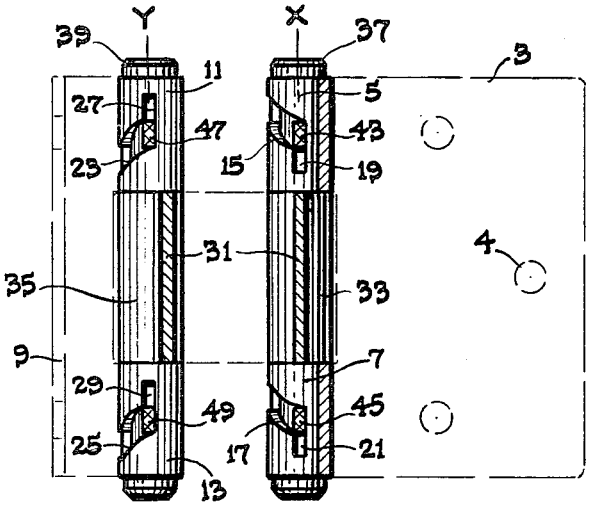
FIG. 7 is an elevation taken along line 7—7 of FIG. 6 showing schematically the relation of the sequencing link ears and cam slots.
Figure 8:
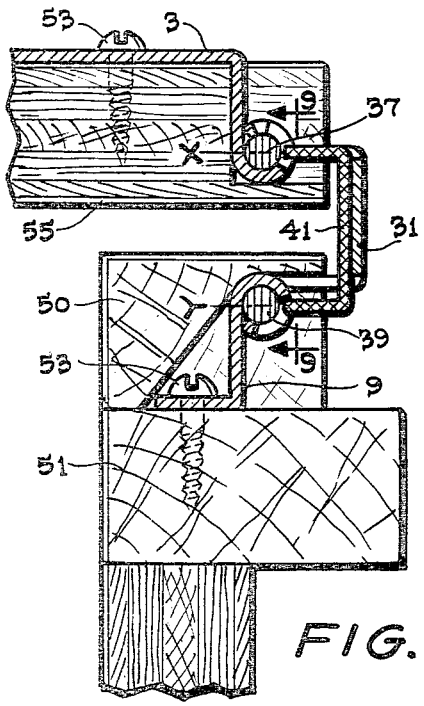
FIG. 8 is the plan view of FIG. 4 with the door opened 180°.
Figure 9:
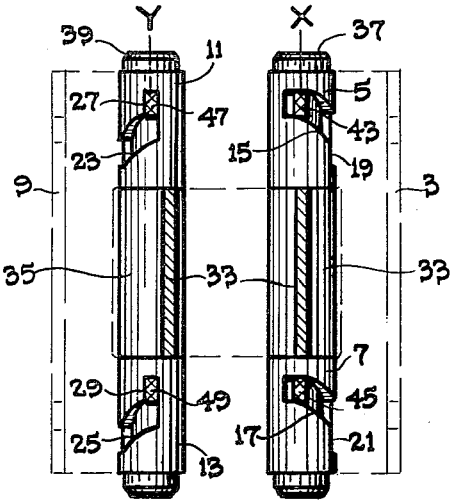
FIG. 9 is an elevation taken along 9—9 of FIG. 8 showing schematically the relation of the sequencing link ears and cam slots.

As door 55 begins to open hinge plate 31 will begin to pivot about pin 39 and the door 55 together with plate 3 and sequencing link 41 will move outward. At this point plate 3 will not pivot about pin 37 because ears 43 and 45 of sequencing link 41 are in locking engagement with notches 19 and 21. However, pivotal movement about pin 39 causes the lower surfaces of slots 23 and 25 to act as cams and exert an upward force against ears 47 and 49 of link 41. This causes ears 43 and 45 to gradually move out of locking engagement with locking notches 19 and 21 while ears 47 and 49 move progressively along cam slots 23 and 25 toward the end of the cammed portion of these slots. The design of the slots and notches is such that just as the door 55 is pivoted 90°, as shown in FIGS. 6 and 7, ears 43 and 45 will just disengage locking notches 19 and 21 as ears 47 and 49 reach the top of the cammed portion of slots 23 and 25 and into a position to immediately engage locking notches 27 and 29. At this point pivoting or rotation on pin 39 ceases and pivoting or rotation automatically starts on pin 37. Further outward movement of door 55 will cause the lower surfaces of slots 15 and 17 to act as cams and exert an upward force on ears 43 and 45. This immediately moves ears 47 and 49 into locking engagement with notches 27 and 29. Door 55 will now open to a full 180° as shown in FIGS. 8 and 9. When it is desired to close door 55 the sequence of events above described is reversed. Pivoting takes place first about pin 37 with jamb plate 9 locked. After 90° of pivotal movement toward closing door plate 3 locks as plate 9 unlocks and pivoting continues about pin 39.

Figure 10:
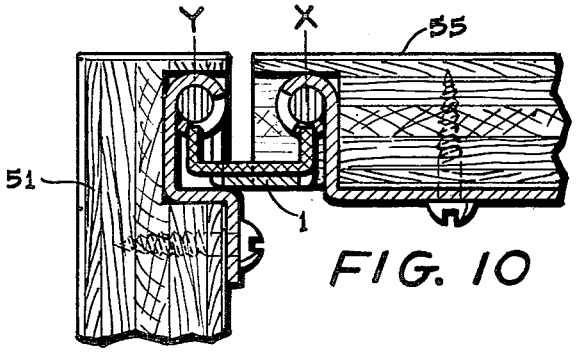
FIG. 10 is a plan view of an alternate mounting of my hinge.

Having disclosed my invention and described it in detail, it will be apparent to those skilled in the art that many variations could be made without departing from the true spirit and scope of my invention. For example, the relationship of the notches and ears could be varied to provide a different pivoting series. As shown in FIG. 10, the hinge could also be mounted differently on the door and cabinet. I claim as my invention all such variations as fall within the scope and equivalence of the appended claims.

I claim:

1. A hinge comprising:

a first plate member including a first pivot journal defining cam means;

a second plate member including a second pivot journal defining cam means;

a movable pivot sequencing member operatively connected to the cam means on the first and second plate members;

a third plate member operatively connected to the first and second plate members in substantially surrounding relation to the sequencing member;

and means for locking the sequencing member and either the first plate member or the second plate member together while the unlocked member pivots.

2. The apparatus of claim 1 wherein the cam means includes a curved slot defined by a pivot journal on the first and second plate members, the slots further defining locking notches engageable by the sequencing member.

* * * * *